US005461448A

United States Patent [19]

Eeles et al.

[11] Patent Number: 5,461,448

[45] Date of Patent: Oct. 24, 1995

[54] PHOTOGRAPHIC PROCESSING APPARATUS

[75] Inventors: Alan G. Eeles, Bellingdon; Leslie J. Pummell, Rickmansworth; Stephen J. Kingdon, St. Albans, all of United Kingdom

[73] Assignee: Eastman Kodak Company, Rochester, N.Y.

[21] Appl. No.: 168,893

[22] Filed: Dec. 16, 1993

[30] Foreign Application Priority Data

Dec. 19, 1992 [GB] United Kingdom ..... 9226507

[51] Int. Cl.[6] ..... G03D 3/08

[52] U.S. Cl. ..... 354/320; 354/321; 354/322; 354/331

[58] Field of Search ..... 354/319–324, 354/331, 336, 340; 226/181, 188, 189, 190; 134/64 P, 64 R, 122 P, 122 R

[56] References Cited

U.S. PATENT DOCUMENTS

| | | | |
|---|---|---|---|
| 2,475,658 | 7/1949 | Briechle | 354/339 |
| 2,786,736 | 3/1957 | Roughsedge | 354/324 |
| 2,853,294 | 9/1958 | Woodcock | 354/339 |
| 2,913,974 | 11/1959 | Sabel et al. | 354/322 |
| 3,698,306 | 10/1972 | Fairbanks | 354/322 |
| 4,416,529 | 11/1983 | Kastl | 354/320 |
| 4,613,223 | 9/1986 | Cherry et al. | 354/322 |
| 4,745,423 | 5/1988 | Uchida | 354/320 |
| 4,864,354 | 9/1989 | Crasnianski | 354/322 |
| 4,943,823 | 7/1990 | Uchiyama et al. | 354/322 |
| 5,327,189 | 7/1994 | Wernicke et al. | 354/319 |

FOREIGN PATENT DOCUMENTS

| | | | |
|---|---|---|---|
| 0037560 | 10/1981 | European Pat. Off. | 354/319 |
| 3209262 | 9/1993 | Germany . | |
| 60-129748 | 7/1985 | Japan | 354/323 |
| 2059813 | 4/1981 | United Kingdom | 354/321 |
| 90/08981 | 8/1990 | WIPO . | |

*Primary Examiner*—D. Rutledge
*Attorney, Agent, or Firm*—Peter J. Bilinski

[57] ABSTRACT

A processing rack for use in a processing apparatus. The rack for a given processing path length has an overall height reduction. The rack includes an inlet and an outlet, and switch for directing the material to be processed either directly to the outlet or around a processing path defined by a roller arrangement. The processing path so defined is folded to provide an acceptable path length but reducing the overall height of the processing rack.

2 Claims, 3 Drawing Sheets

PHOTOGRAPHIC PROCESSING APPARATUS

FIELD OF INVENTION

This invention relates to photographic processing apparatus and is more particularly concerned with automatic processing apparatus.

BACKGROUND OF THE INVENTION

Automatic processing apparatus are known in which a processing rack defines a simple track along which the material being processed is driven in a simple loop. However, this simple track must have a path length which is sufficient to accommodate at least the length of the material to be processed without the material overlapping itself. This, in turn, dictates the minimum height of the processing rack and hence the overall size of the processing apparatus of which the rack forms a part.

In known processing apparatus, the track length is approximately 2 m giving a minimum overall height of around 1 m. This has the disadvantage that it is difficult to remove the processing rack from the apparatus for maintenance and repair.

SUMMARY OF THE INVENTION

It is therefore an object of the present invention to provide a processing rack arrangement which allows the overall height of the processing apparatus to be substantially reduced, but maintains a sufficient path length to permit processing to take place.

In accordance with one aspect of the present invention, there is provided photographic processing apparatus comprising at least one processing tank having processing solution maintained at a predetermined level therein, each processing tank having a processing rack mounted therein, each processing rack having a processing path defined by a circulation loop along which material to be processed is driven, the rack being partially submerged in the processing solution so that the solution level is above the top of the circulation loop, characterized in that for a given processing path length, the overall height of the rack is substantially reduced.

By this arrangement, the height of the processing rack is much reduced so that the rack can be removed more easily from the apparatus, and the overall size can also be reduced.

For a better understanding of the present invention, reference will now be made, by way of example only, to the accompanying drawings in which:

DESCRIPTION OF THE PREFERRED EMBODIMENTS

The present invention will be described with reference to film processing apparatus, but other types of photographic material may be processed in similar apparatus embodying the present invention.

In the following description, the apparatus will be described for processing film lengths in the range of 30 cm to 1.5 m (12 in to 5 ft). Film strips of shorter length will require additional drive roller pairs, and for longer strips, the overall recirculating track length will need to be appropriately extended.

Figure 1:
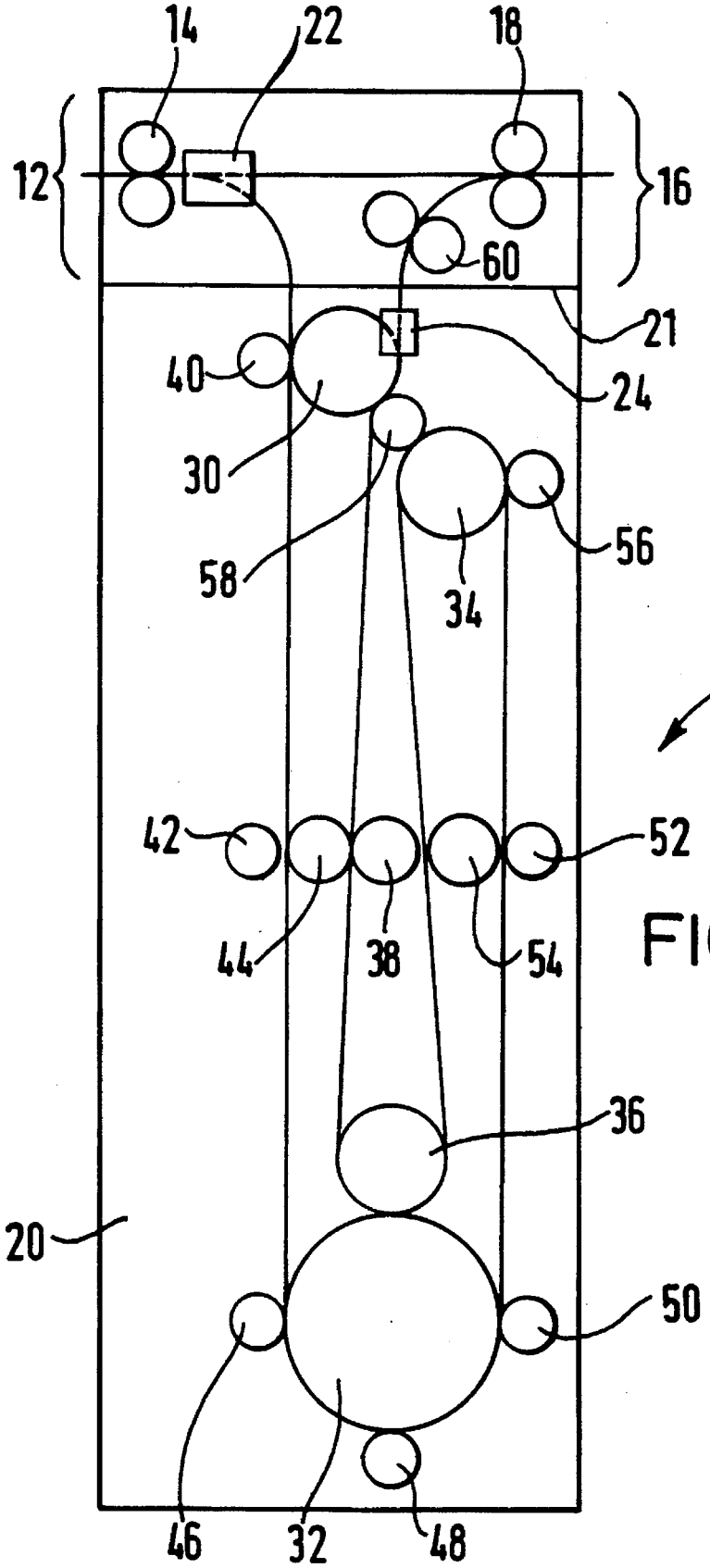
FIG. 1 illustrates one embodiment of a processing rack constructed in accordance with the present invention.

In FIG. 1, a rack 10 is shown which may be fitted into existing processing apparatus. The rack 10 has an inlet 12 defined by rollers 14, an outlet 16 defined by rollers 18, and processing tank 20. Processing solution is maintained at a level indicated by 21.

A switch arrangement 22 is provided after the inlet 12 to direct the film to be processed either into the processing tank 20 or to the outlet 16 if processing is not required in tank 20.

In tank 20 below the solution level 21, rollers 30, 32, 34, 36, 38 are driven at speeds to give the same peripheral velocity. This prevents scratching of the film as it is driven through the rack 10. Pressure rollers 40, 42, 44, 46, 48, 50, 52, 54, 56 are sprung loaded, by means not shown, to allow easy passage of the film between each roller pair. Furthermore, pressure rollers 40, 42, 44, 46, 48, 50, 52, 54, 56 are appropriately geared to rollers 30, 32, 34, 36, 38. A further roller 58 is wedged between rollers 30, 34.

Film to be processed enters the tank 20 through roller pair 30, 40, passes down through roller pair 42, 44, is turned around by rollers 46, 48, 50 acting on roller 32, passes up through roller pair 52, 54, is turned around by roller 56 acting on roller 34, passes back down through roller pair 38, 54, around roller 36, back up through roller pair 38, 44, and up to roller pair 30, 58. Here the film encounters a second switch arrangement 24 which operates to either direct the film out of the tank 20 towards squeegee roller pair 60, or around the processing path again through roller pair 30, 40. Operation of switch 24 to switch the film out of the tank 20 depends on the processing time required for that particular film material. The processing path for the film is shown by solid lines in FIG. 1.

Intermediate rollers 42, 44, 52, 54 are only required if it is desired to process film strips having a length which is shorter that the distance between roller pairs 30, 40 and 32, 46 so that transmission of drive to the film strip can be maintained.

As shown in FIG. 1, for a given processing path length, the overall height of the rack is reduced by approximately 50%.

Figure 2:
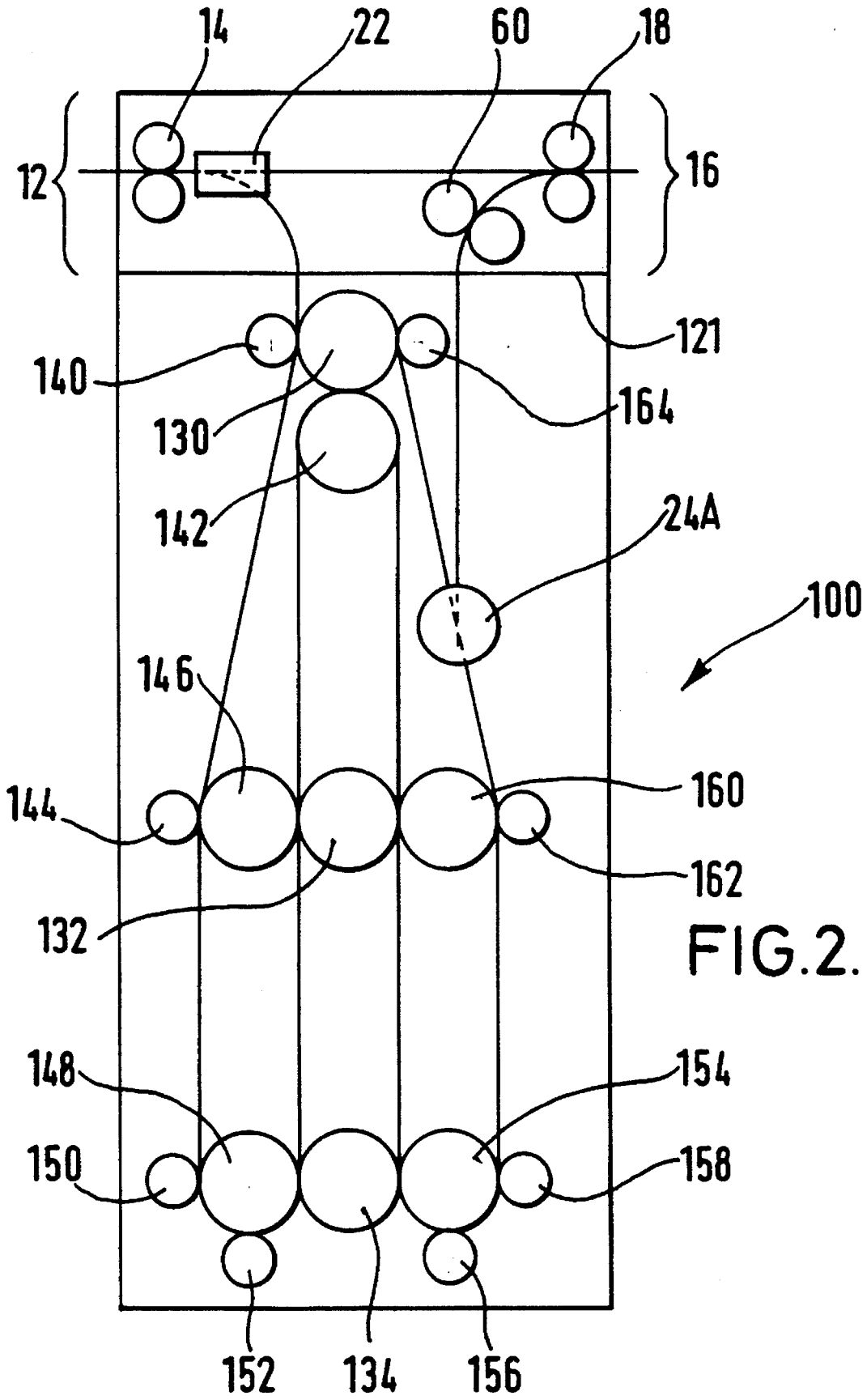
FIG. 2 illustrates a second embodiment of a processing rack constructed in accordance with the present invention.

A second embodiment of the present invention is shown in FIG. 2. Components already described are referenced the same. A rack 100 is shown having a processing tank 120 having processing solution at a level indicated by 121. The inlet-outlet path is as described with reference to FIG. 1.

In this embodiment, two sizes of rollers are utilized. This substantially reduces the inventory of parts required for this particular rack arrangement.

Rollers 130, 132, 134 are driven and rollers 140, 142, 144, 146, 148, 150, 152, 154, 156, 158, 160, 162, 164 are suitably geared. All of rollers 140, 142, 144, 146, 148, 150, 152, 154, 156, 158, 160, 162, 164 are sprung loaded and all but rollers 142, 152, 156 are free to move horizontally, rollers 142, 152, 156 moving vertically against rollers 130, 148, 154 respectively, against spring pressure (not shown). The spring pressure imparts drive to the film as it passes through the processing tank 120.

Switch 24A operates in a similar way to switch 24 (discussed previously), but its positioning in the tank 120 is different. Again, the processing path for the film is shown in solid lines.

As with embodiment of FIG. 1, the processing rack has an overall height reduction of approximately 50%.

Figure 3:
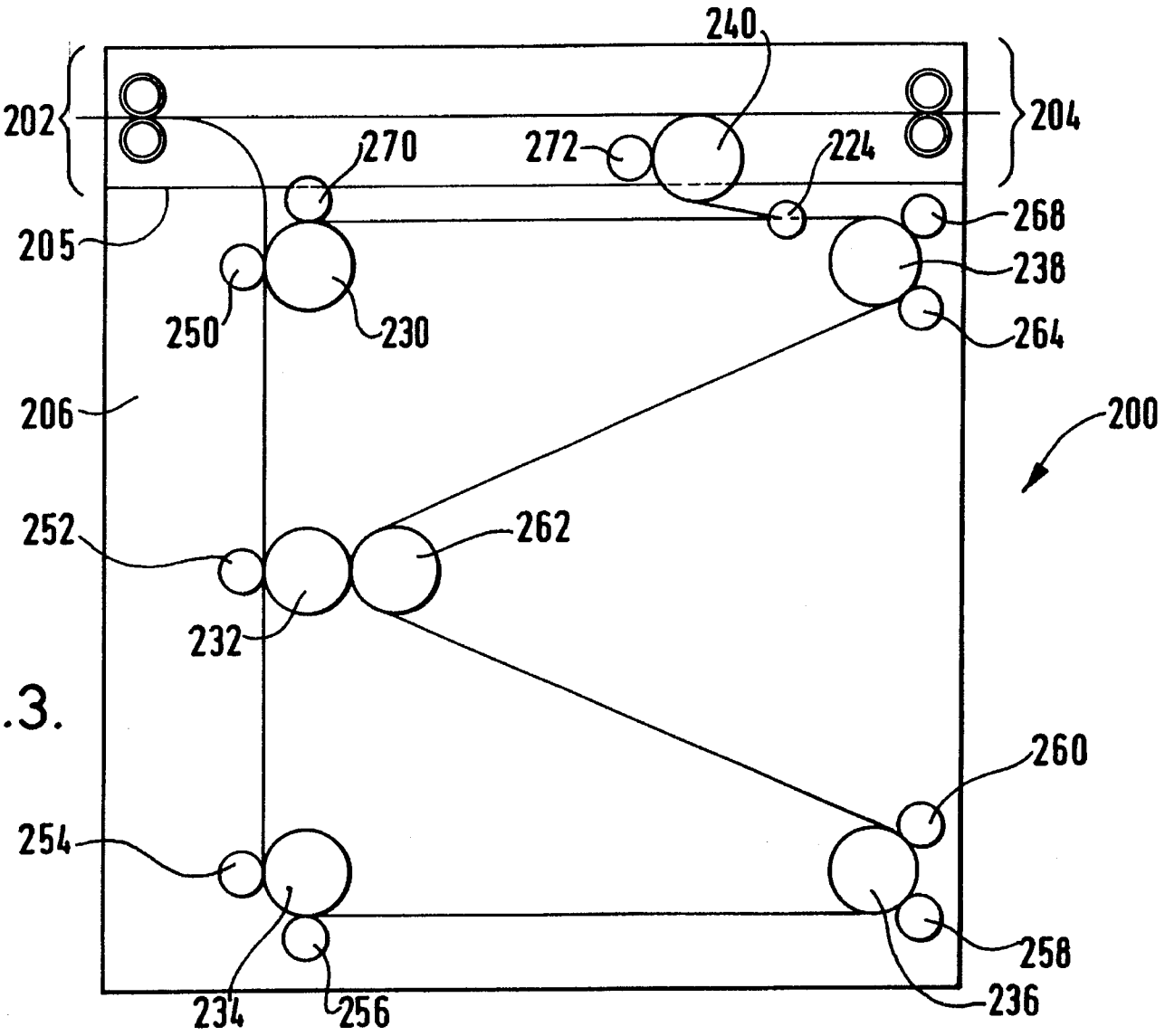
FIG. 3 illustrates a third embodiment of a processing rack constructed in accordance with the present invention.

FIG. 3 illustrates a third embodiment of the present invention. Here, a rack 200 has an inlet 202, an outlet 204 and a processing tank 206. Processing solution is maintained at a level indicated by 205. As described previously with reference to FIG. 1, it is possible for the film to bypass processing tank 206 and pass directly from the inlet 202 to the outlet 204, the necessary switching arrangements allowing this to occur not being shown for clarity.

In this arrangement, rollers 230, 232, 234, 236, 238, 240 are driven with rollers 250, 252, 254, 256, 258, 260, 262, 264, 266, 268, 270, 272 being pressure rollers. Switch 224 is positioned to switch the film either out of the tank 206 or on to roller pair 230, 270 for further processing in the processing path. As before, the processing path for the film is shown as a solid line.

It will be appreciated that for each roller pair, the roller surfaces in contact with the film may extend across all or any part of the film surface in order to transmit drive to the film during processing.

Rack stiffness can be improved due to the folded rack arrangement. This has the advantage that a lighter and cheaper arrangement can be utilized.

Moreover, some embodiments of the present invention may allow smaller volume tanks to be used. However, this will depend on the particular configuration of the rollers within the rack and the sizes of the rollers employed.

The present invention can be applied to any processing machine using strips of web which must be processed in a compact tank.

Parts List:

10 . . . rack
12 . . . inlet
14 . . . rollers
16 . . . outlet
18 . . . rollers
20 . . . processing tank
21 . . . solution level
22 . . . switch arrangement
24,24A . . . switch arrangement
30,32,34,36,38 . . . rollers
40,42,44,46,48,50,52,54,56 . . . pressure rollers
58 . . . roller
60 . . . squeegee roller pair
10 . . . rack
120 . . . processing tank
121 . . . solution level
130,132,134 . . . rollers
140,142,144,146,148,150,152,154,156,158,160,162,164 . . . rollers
200 . . . rack
202 . . . inlet
204 . . . outlet
205 . . . solution level
206 . . . tank
224 . . . switch
230,232,234,236,238,240 . . . rollers
250,252,254,256,258,260,262,264,266,268,270,272 . . . rollers

We claim:

1. An apparatus for processing photographic material comprising:

at least one processing tank containing a processing solution which is maintained at a predetermined level therein;

a processing rack comprising a series of roller pairs for transporting a photographic material along a defined processing path, and in which a portion of said processing rack is wholly submerged in said processing solution;

wherein the submerged portion of the processing rack includes a plurality of roller pairs in which a roller from each roller pair forms a roller in another roller pair and in which the roller pairs of said rack are arranged so as to form a folded processing path, said folded processing path defined by a series of at least four folded path sections, and in which the processing path in the processing solution is defined by a circulation loop wherein the processing rack includes switching means for either moving the photographic material out of the processing tank after the material has passed through the circulation loop or redirecting the photographic material through the circulation loop.

2. A processing apparatus as recited in claim 1, wherein the portion of the processing rack not submerged in the processing solution includes switching means for selectively moving the photographic material either into or away from the portion of the processing tank which is submerged in the processing solution.

* * * * *